United States Patent [19]

Carpenter

[11] 4,324,053

[45] Apr. 13, 1982

[54] ANTI-POLLUTION ROTARY-SWEEP GRAIN DRIER

[75] Inventor: Rodney W. Carpenter, Milford, Ind.

[73] Assignee: Clayton & Lambert Manufacturing Co., Buckner, Ky.

[21] Appl. No.: 179,745

[22] Filed: Aug. 20, 1980

Related U.S. Application Data

[63] Continuation of Ser. No. 894,181, Apr. 6, 1978, Pat. No. 4,241,517.

[51] Int. Cl.[3] ..... F26B 19/00

[52] U.S. Cl. ..... 34/236; 34/233; 198/518; 198/603

[58] Field of Search ..... 34/168, 173, 174, 225, 34/233, 236; 98/55; 198/518, 522, 558, 616, 671

[56] References Cited

U.S. PATENT DOCUMENTS 2,733,904 2/1956 Gauthier et al. ..... 198/518
4,085,520 4/1978 Lambert, Jr. ..... 34/233

FOREIGN PATENT DOCUMENTS 1233567 10/1960 France ..... 34/236

*Primary Examiner*—Lloyd L. King

*Assistant Examiner*—Harold Joyce

*Attorney, Agent, or Firm*—Maurice L. Miller, Jr.

[57] ABSTRACT

An improved grain drying apparatus of the type having a bin with a perforated floor through which hot air is blown upward for grain drying purposes, and a rotary sweep assembly employing a wet grain distributing auger on its lag side and a dried grain retrieving auger on its lead side. One improvement includes an inclined elongate plate forming an overflow dam which extends along the floor on the lead side of the retrieving auger and which is connected to the sweep assembly for rotation therewith so as to build up the thickness of dried grain on the floor ahead of the retrieving auger to increase the resistance of the dried grain to the upward flow of hot air on the lead side such that a greater proportion of hot air will flow upwardly through the floor on the lag side through the wet grain being deposited thereon. Additional features include provision for connecting the suction system of the apparatus to the wet lag side of the bin as well as to a central well into which the retrieving auger deposits dried grain for removal from the bin, and a system for recycling air suctioned from the bin through an external cyclone dust separator back into a plenum chamber under the perforated floor.

5 Claims, 10 Drawing Figures

ANTI-POLLUTION ROTARY-SWEEP GRAIN DRIER

CROSS REFERENCES TO RELATED APPLICATIONS

This application is a continuation of my previously filed co-pending application bearing the same title, Ser. No. 894,181, filed Apr. 6, 1978 now U.S. Pat. No. 4,241,517.

BACKGROUND OF THE INVENTION

1. Field of the Invention

This invention relates to the art of drying wet grain, continuously or batchwise, and to the air pollution problem it creates.

2. Description of the Prior Art

The Francis U.S. Pat. No. 3,449,840 and Lambert, Jr. U.S. Pat. Nos. 3,755,917 and 4,085,520 all disclose a grain drying apparatus of the continuous (or batch) rotary sweep type and are all owned by a common assignee, the Clayton & Lambert Manufacturing Company of Buckner, Kentucky 40010. As a continuous drier, the lag side of the sweep continuously deposits wet grain as it rotates, say counter-clockwise (CCW), over a circular perforated floor, to form a circular layer of grain extending clockwise (CW) on the floor from the wet lag side of the sweep to the lead side thereof. This circular layer of grain dries progressively from the wet lag side to the dry lead side of the sweep as hot air is blown upwardly through the layer. As it dries, its thickness decreases; hence, its dry end is much thinner than its wet end. The dry lead side of the sweep continuously retrieves dried grain from the adjacent dry end of the circular layer. The moist or wet hot air, flowing from the entire layer, is contaminated with fugitive dust. It is discharged from the bin into the ambient atmosphere, thereby polluting the atmosphere.

SUMMARY OF THE INVENTION

Objects of the Invention

The principal objects of the present invention are: to reduce the loss of heat passing through the dry grain and flowing into the suction system on the dry lead side of the sweep; to increase the recovery of fugitive dust created within the confines of the sweep as a whole; to reduce the emission of fugitive dust into the ambient atmosphere; and to improve the general design.

Statement of the Invention

The aforesaid Lambert, Jr. U.S. Pat. No. 4,085,520, which adds said anti-pollution system to the prior art grain driers, includes a suction canopy chamber embracing the fugitive dust created along the lead side of the sweep and a duct system leading to a high efficiency cyclone separator for separating and recovering that dust and discharging the clean air into the ambient atmosphere.

I have come to appreciate that, since the depth of the dry end portion of the grain layer decreases more or less progressively as it approaches the point of retrieval, there is, in said Lambert anti-pollution system, a progressive increase in the amount of unused hot air flowing from that progressively thinner layer of grain; hence, I propose to provide the lead side of the sweep with an overflow dam, which compels the grain in the dry end portion of the layer to build up to and remain at a desired thickness and then overflow into the dry grain retrieving or removal means. In this way, the resistance of the dry end portion of the layer to the flow of hot air is increased over what it would otherwise be with a consequent decrease in the amount and temperature of the hot air discharging from that portion and flowing into the suction system.

Moreover, I have found that fugitive dust is also created on the wet lag side of the sweep by the incoming wet grain as it falls toward the floor and that much of this wet-side dust, together with the dust created by the outgoing dry grain discharging into the center well, can be sucked through the suction canopy chamber into the anti-pollution duct system and thus prevented from escaping through the bin atmosphere to the outside ambient atmosphere.

Furthermore, in accordance with my invention, the clean air, discharging from the outlet of the high efficiency cyclone used in the anti-pollution system, may be directed back into the grain drying bin under its perforated floor so that the dust and heat content are once again subject to recapture. Preferably, the cyclone outlet air is recycled into the bin through one of its air heaters. Finally, I improve the design, particularly the inner end support of the rotary sweep.

BRIEF DESCRIPTION OF THE DRAWINGS

The invention is illustrated in the accompanying drawing wherein.

DESCRIPTION OF THE PREFERRED EMBODIMENT

Figure 1:
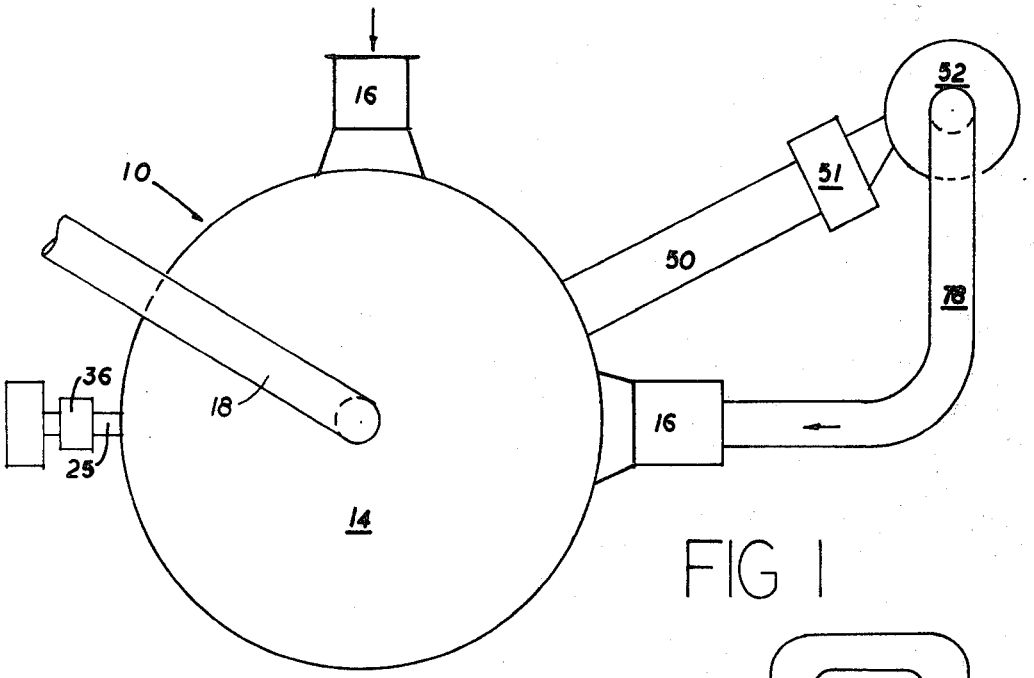
FIG. 1 is a top plan view of a grain bin installation embodying the present invention.
Figure 2:
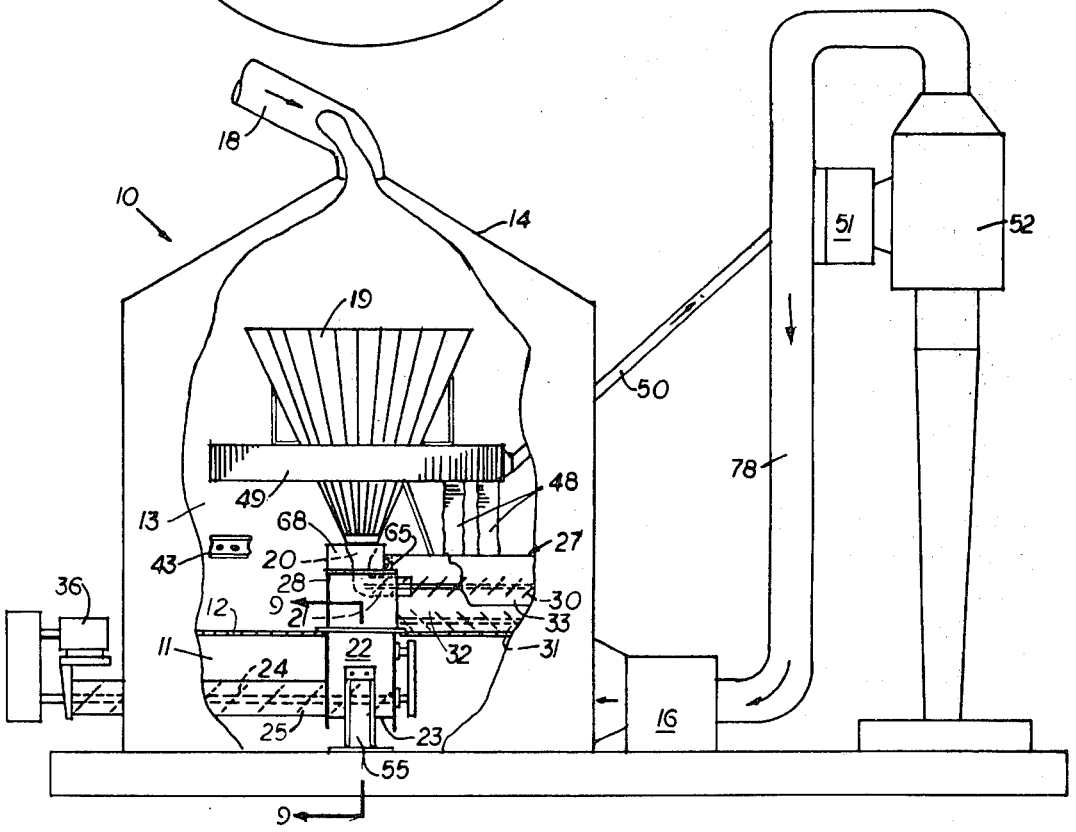
FIG. 2 is a partly broken side elevation of FIG. 1.
Figure 3:
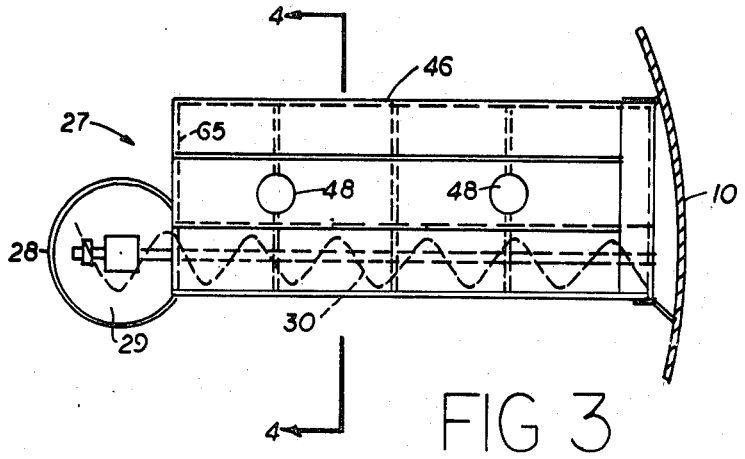
FIG. 3 is a somewhat schematic top plan view showing the positional relationship of important rotary sweep parts between the outer wall of the bin and the vertical axis thereof.
Figure 4:
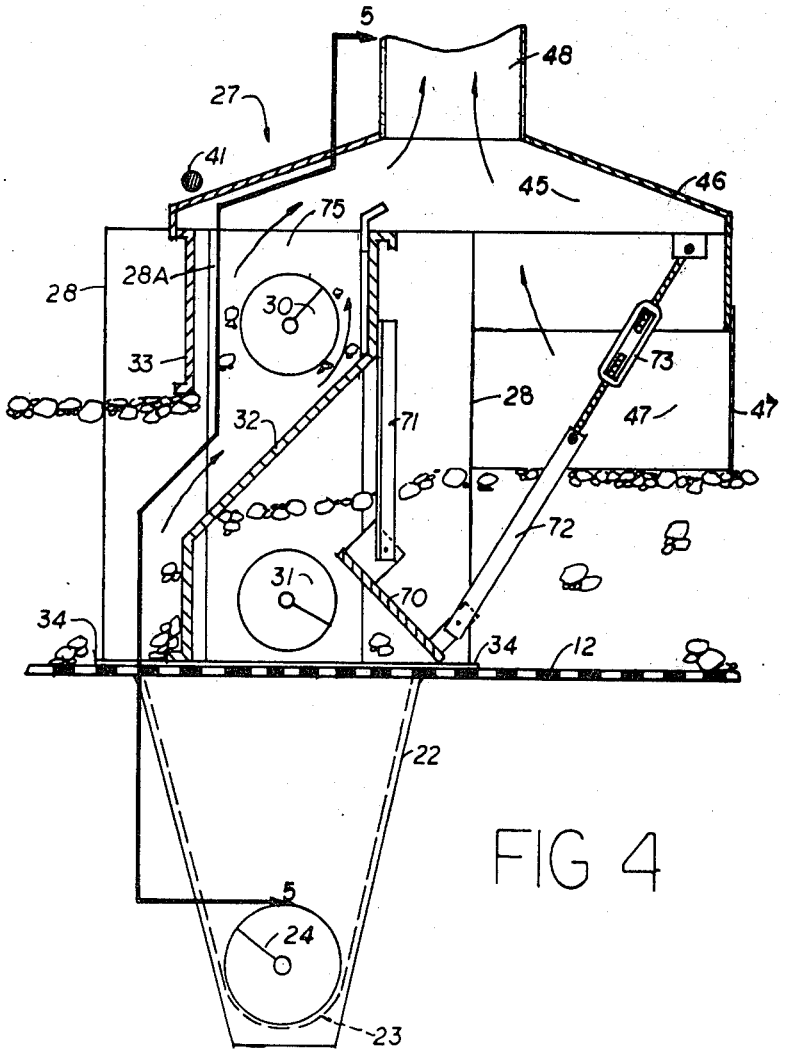
FIG. 4 is a section taken along line 4—4 of FIG. 3 to show the left or lag and right or lead sides of the sweep.

The structure illustrated comprises: a Lambert-type of anti-pollution grain drying apparatus; and my improvement.

THE LAMBERT APPARATUS

The Lambert apparatus illustrated, which includes a grain drier of the type disclosed in the Francis and Lambert U.S. Pat. Nos. 3,449,840 and 3,775,917, and which also includes the Lambert anti-pollution apparatus of said U.S. Pat. No. 4,085,520, conventionally comprises: a grain bin; grain drying means; wet grain feed means; dry grain discharge means; a rotary sweep; sweep drive means; sweep support means; and Lambert's anti-pollution means.

GRAIN BIN

The grain bin 10 has a bottom plenum chamber 11 under a perforated partition or floor 12 separating the plenum chamber 11 from an upper drying chamber 13, having one or more wall openings (not shown) for discharging the hot moisture-laden air into the ambient atmosphere. The top of the grain bin is covered by a conical roof 14.

GRAIN DRYING MEANS

The grain drying means simply comprises a "hot air" blower 16 mounted to blow atmospheric air through a heater (not shown) into the bottom plenum chamber 11 to establish a continuous flow of hot drying air from the bottom plenum chamber successively through the floor 12, a grain layer on the floor 12, the drying chamber 13 and one or more air discharge openings in the bin wall.

WET GRAIN FEED MEANS

The wet grain feed means includes: an inlet conduit 18, feeding grain to and downwardly through the center of the conical roof 14; a conical wet grain hopper 19, mounted on the interior bin walls to receive the incoming wet grain; and a funnel-mouthed conduit 20 centrally positioned not only to receive wet grain from the bottom of conical hopper 19 but also to feed that grain downwardly along the axis of the bin into the lag side of the rotary sweep. The vertical conduit terminates at its lower end in a horizontal sleeve 21 having an inner closed end and an outwardly projecting outer end.

DRY GRAIN DISCHARGE MEANS

The dry grain discharge means comprises: a stationary trough 22 having an open top positioned adjacent the level of a centrally disposed opening in the bin floor, straight end walls and V-slanted side walls which terminate in a rounded or semicylindrical bottom wall 23; and a conveyor auger or screw 24 extending radially along the rounded bottom 23 of trough 22 and through a conveyor pipe 25 projecting, from an opening in one end wall of the trough, successively through the plenum chamber 11 and an outer wall of the bin to a desired discharge area outside of the bin.

ROTARY SWEEP

The rotary sweep 27 comprises: a rotary cylinder 28 concentric to the vertical axis of the sweep 27 and vertically arranged, at the floor level of the bin, to open downwardly into said V-shaped trough 22 with which it cooperates to form a vertical center well 29; a wet grain distributing conveyor 30 arranged on the lag side of the sweep with its inner end house in sleeve 21; a dry grain retrieving conveyor 31 arranged on the lead side thereof with its inner end housed in choke sleeve 31A; a horizontally elongate vertical partition wall 32 projecting radially from the rotary cylinder 28 to separate the lag side of the sweep from the lead side thereof, and having horizontally offset upper and lower vertically straight portions and a rearwardly declining or slanted vertical mid-portion separating the upper lag-side wet grain distributing conveyor 30 from the lower underlying lead-side dry grain retrieving conveyor 31; and a radially-elongate leveling wall 33, on the lag side of the lag conveyor 30. The cylinder 28 is slotted on its auger side, its slot edges flanged and its slot closed by a shallow U-shaped channel 28A, through which the augers pass.

Rotary sweeps may be arranged to rotate horizontally in sweep fashion in either direction. For the sake of clarity, the sweep illustrated will be referred to throughout this application as moving counter-clockwise (CCW). It receives an incoming stream of wet grain from the wet grain feed means through conduit 20, 21 and drops it on the floor where it piles up, its lag side conveyor 30 distributes that pile of grain radially over the floor, its leveling wall 33 scrapes the distributed grain to maintain the wet end of the circular layer at a desired thickness, and its lead side conveyor 31 moves the dry end of the circular layer inwardly to the center well 29 where it drops into trough 22 of the dry grain discharge means.

A suitable seal 34 is interposed between the round bottom of rotary cylinder 28 and a round hole in a plate placed on the top of the stationary trough 22 to facilitate relative rotation therebetween. The seal 34 doesn't transmit weight.

DRIVE MEANS

Figure 5:
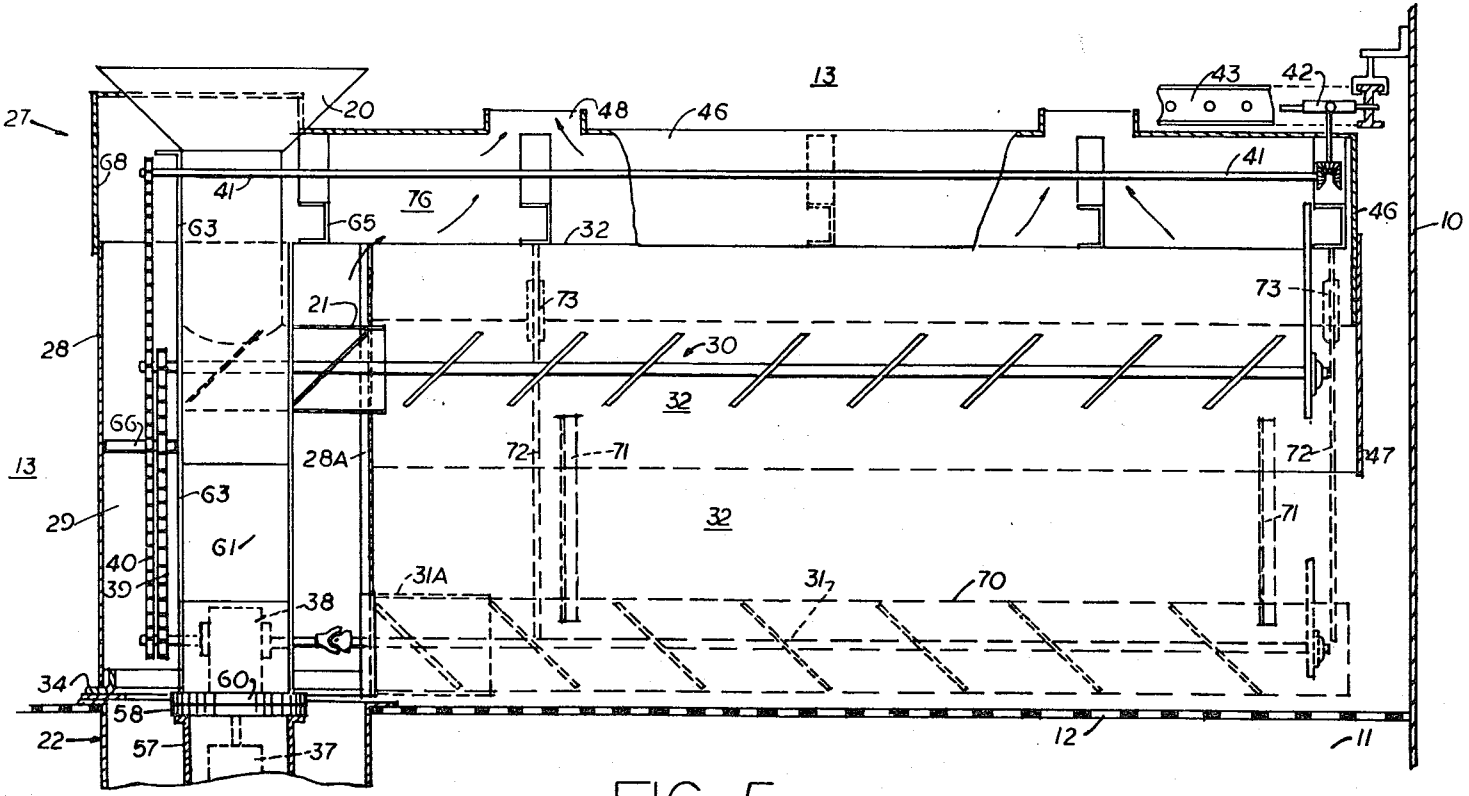
FIG. 5 is a partly broken vertical section taken along line 5—5 of FIG. 4.
Figure 6:
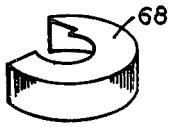
FIG. 6 is a perspective view of the parti-cylindrical cap covering the outermost part of the top of the center cylinder.
Figure 7:
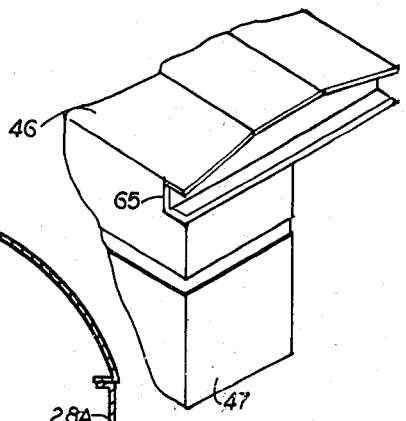
FIG. 7 is a fragmentary perspective view of the innermost end of the canopy.
Figure 8:
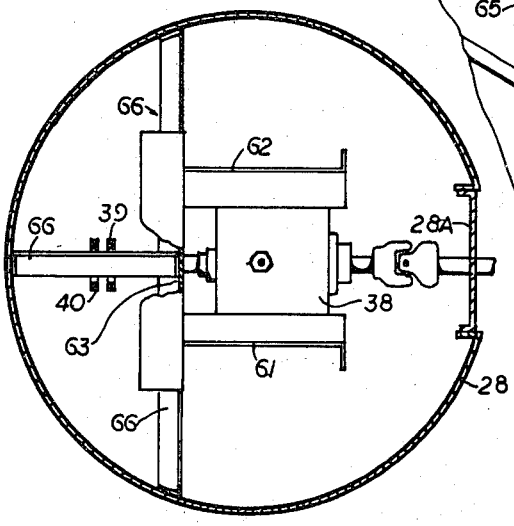
FIG. 8 is a horizontal section through the upper part of the center cylinder, this view, which looks downward, omits the funnel-mouthed grain inlet conduit and the inner ends of the upper and lower grain-handling augers.
Figure 9:
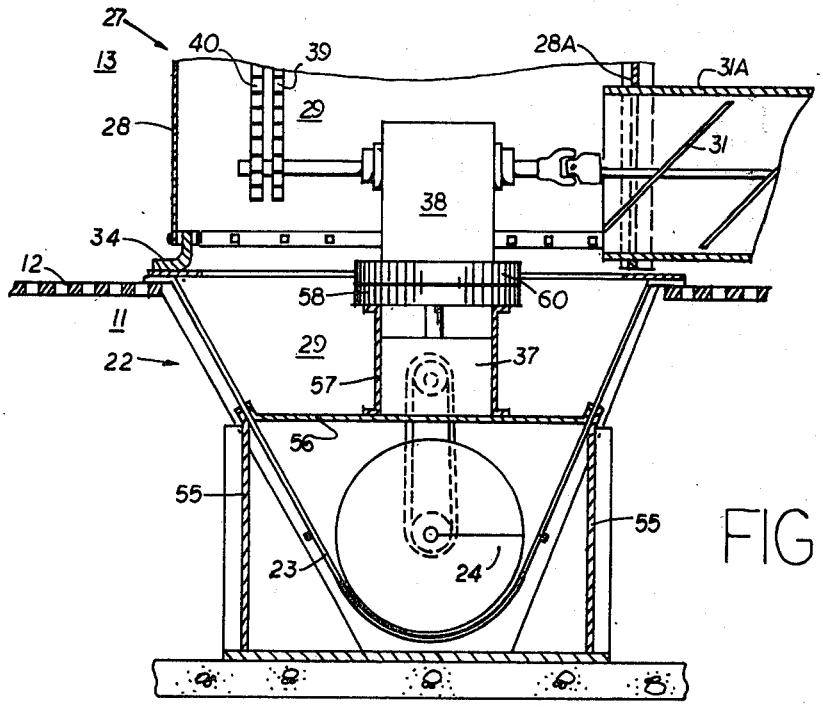
FIG. 9 is an enlarged section along line 9—9 of FIG. 2 with the rotary sweep swung 90° CCW from its position in FIG. 2.
Figure 10:
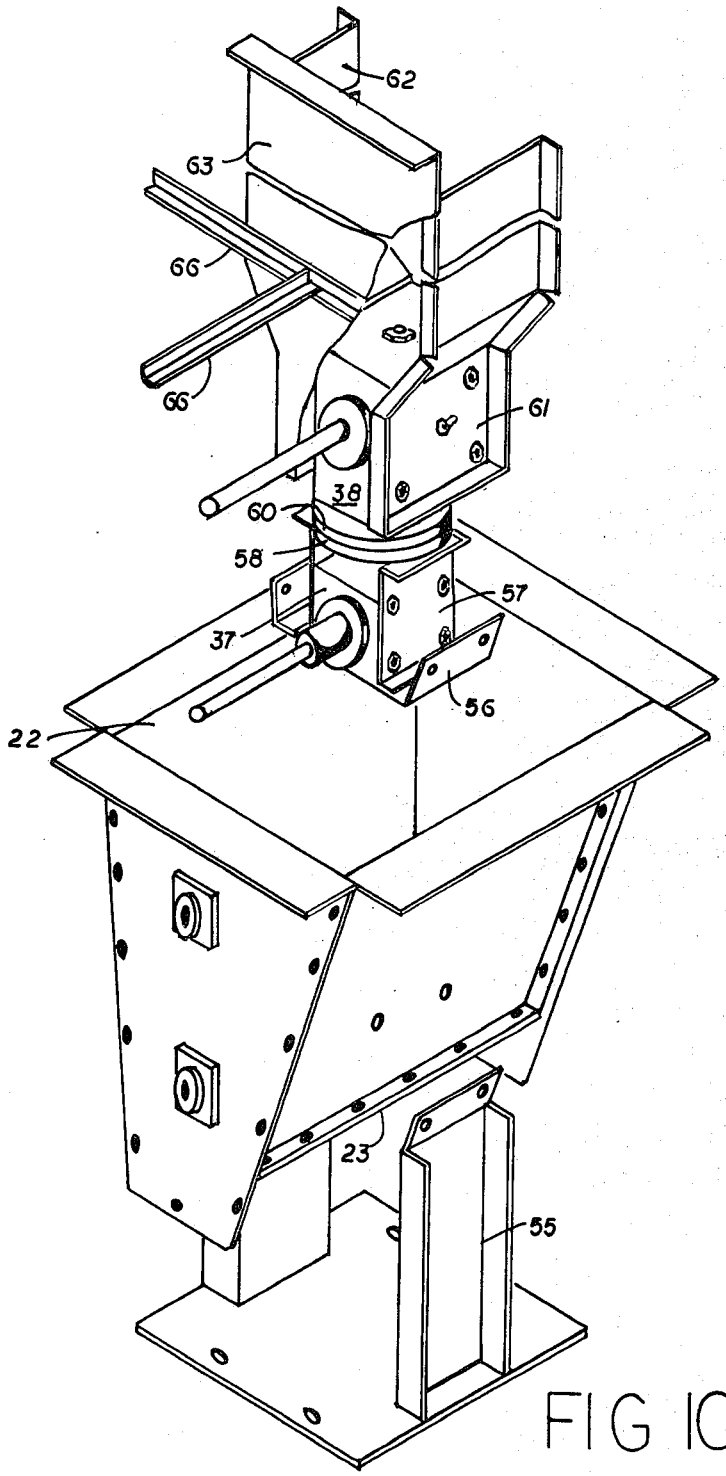
FIG. 10 is a vertically exploded view of the center support means and grain trough.

The drive means requires only one outside electric motor 36 to drive the dry grain discharge and retrieving augers 24 and 31, the wet grain distributing auger 30 and the rotary sweep 27. To drive the dry grain discharge auger 24, motor 36 is connected to the outer end thereof. To drive the retrieving auger 31, the inner end of the bottom grain discharge auger 24 is connected to the retrieving auger 31 through a vertically spaced pair of intermediate and terminal gear boxes 37 and 38 in the center well. As seen in FIG. 5, the intermediate gear box 37 is located in the upper half of stationary trough 22 while the terminal gear box 38 is located in the lower half of rotary cylinder 28. To drive the distributing auger 30, the terminal gear box 38 is connected by chain 39 to the receiving end of the shaft of auger 30. As seen in FIG. 8, the rotary sweep 27 terminal gear box 38 is connected through chain 40 and tracking shaft 41 to a tracking gear 42 which, when rotated, tracks along stationary ring gear 43 carrying the outer end of the sweep with it.

ROTARY SWEEP SUPPORT MEANS

The rotary sweep is supported at its outer and inner ends. The outer end of the sweep is conventionally supported from rollers on the lower flanges of the stationary ring gear 43 and, since this type of support is in the form of a widely known and used outer roller-bracket assembly, it is not deemed necessary to illustrate or describe it.

The inner end of the Lambert rotary sweep was supported largely by an end-to-end vertical post arrangement, including a stationary lower center post and an upper rotatable post, wherein the center weight was transmitted downwardly through the floor level by a power transmitting shaft. My arrangement, which will be subsequently described, supports and transmits all of the center weight upon and through structural members.

THE ANTI-POLLUTION MEANS

The Lambert anti-pollution means, which is in the form of a suction system for removing and capturing airborne dust coming from the grain in the vicinity of the lead side of the sweep, comprises: a suction chamber 45 arranged on the front side of the partition wall 32 to extend over and above the lead side of the sweep, this suction chamber being composed of a canopy 46 forming the roof of the chamber and a depending curtain 47 extending from the periphery of the canopy's opposite end and front walls downwardly into contact with the underlying grain so as to form the vertical end walls and the front wall of the suction chamber; a pair of orbital conduits 48; a hollow donut casing 49; stationary conduit means 50; blower 51; and an outside dust separator 52.

The orbital conduits 48 connect outlets in the roof of the suction chamber canopy 46 to the interior of the donut casing 49 through an inlet in the casing's bottom wall, which is rotationally mounted on the casing's stationary side walls. The stationary conduit means 50 connects the interior of the donut casing 49, through an opening in a stationary wall thereof, to a blower 51 which suctions air from the suction chamber 45 successively through orbital conduits 48, donut casing 49 and the approaching portion of the conduit means 50 and then blows that air through dust separator 52 where the dust is separated from the air and the cleaned air discharged either to atmosphere or in accordance with my invention.

MY IMPROVEMENT

I propose: to improve the support means; to provide an overflow dam, which is useful in the grain drying apparatus whether or not it is equipped with anti-pollution means; and to improve the anti-pollution means.

IMPROVED SUPPORT MEANS

My support means comprises: a lower stationary integrated support assembly; and an upper rotary integrated support assembly.

The lower assembly includes: a pair of trough supporting base brackets 55, one on each slanted outer side of the trough 22 to bridge the vertical space between that side and the bottom of the bin; a cross-bracket 56 arranged transversely within and mounted on the inner slanted faces of the walls of the trough adjacent the upper ends of the vertical brackets 55; a pair of horizontally-spaced upright brackets 57 mounted on cross-bracket 56, one located on each side of the vertical axis of the grain bin adjacent opposite sides of intermediate gear box 37; and an axis-concentric top plate 58 on the upper end of upright brackets 57, which terminate in the vicinity of the floor level. These stationary parts 55–58 and trough 22 are all rigidly connected together and remain stationary at all times.

The upper rotary assembly, which rests rotationally on the top plate 58, includes: a base plate 60 resting on, and in rotational face-to-face relation to, said top plate 58; an integrated three-sided vertical casing having two opposed side walls 61, 62 located at and connected to the opposite sides of terminal gear box 38; and a third or bight wall 63 extending transversely from one side wall 61 to the other side wall 62 and integrated with both. The side walls extend the full vertical length of cylinder 28. The bight wall 63 projects beyond the upper end of the cylinder 28.

The side walls 61, 62 incline for a short distance outwardly upward from the top of the terminal gear box 38 to widen the space therebetween sufficiently to receive the incoming wet feed sleeve 21 which houses the inner end portion of the distributing auger 31 within rotary cylinder 28. The side walls 61, 62 continue straight upwardly along opposite sides of the upper distributing auger 30 and terminate at or near the top of rotary cylinder 28. Bight wall 63 is in the form of a straight plate vertically arranged within the cylinder 28 between the bin axis and the distributing auger 30 and tracking shaft 41 drive chains 39, 40. It extends upwardly beyond the top of rotary cylinder 28 sufficiently to receive and support the inner end of the tracking shaft 41 and terminates near the bottom level of the funnel-mouth of the wet grain receiving conduit 20.

The inner end of dry auger 31 is supported by the housing of terminal gear box 38. The inner end of wet auger 30 is supported on the bight wall 63 of the integrated casing 61–63. Likewise, the inner end of the tracking shaft 41 is supported on the upper end portion of the bight wall 63. Thus the weight of the apparatus at the inner ends of wet and dry augers 30, 31 and of track shaft 41 is transmitted through the integrated casing 61–63, and associated structural parts, directly to base plates 60 of the upper assembly 60–63, thence to the top plate 58 of the lower assembly 55–58.

The innermost roof truss 65 of the canopy rests upon the upper end of the side walls of the integrated casing 61–63. The rotary cylinder 28 is supported on casing 61–63 by means including a T-bracket 66 connecting two points on the inner wall of the cylinder to the casing through the cross bar of bracket 66 and a 3rd point of the cylinder to the casing through the stem of bracket 66. The casing also supports the funnel-mouthed conduit 20, its sleeve 21 and air-locking choke sleeve 31A of retrieving auger 31. The roof of canopy 46 covers a small portion of the open top of rotary cylinder 28. The remainder of the open top of cylinder 28 is covered by a parti-cylindrical cap 68, i.e. a partial band-shaped or ring-shaped cap, having a closed top and an open bottom. The top of cap 68 is on a level slightly above the uppermost level of canopy 46. Suitable walls (not shown) close any vertical openings resulting from this difference in levels.

OVERFLOW DAM

In accordance with a particular feature of my invention, an overflow dam is arranged on but near the lead side of the lead auger 31 so that, as the rotary sweep 27 sweeps forwardly, it piles up the dry grain in front of it until the dry grain layer thickness exceeds the vertical height of the dam whereupon the dry grain begins to overflow the dam.

The dam is in the form of an elongate metal plate 70 which is slightly longer than the horizontal space between the bin wall and the outer end of the air-locking sleeve 31A of dry auger 31. The plate 70 is supported from the lead side of partition wall 32 by two or more horizontally spaced vertical bars 71 and from the truss system of the canopy 46 by two or more slanted bars 72 which may be lengthened or shortened by turn-buckles 73 or other suitable adjustable means. The overflow feature is useful in continuous batch driers of the type illustrated with or without any anti-pollution means.

IMPROVED ANTI-POLLUTION MEANS

The anti-pollution means is improved, in accordance with my invention, by extending the canopy 46 rearwardly over the lag side of the rotary sweep so as to extend over the lag space 75, which extends on all sides of lag auger 30 between partition wall 32 and leveling wall 33. The lag space 75 communicates with the space extending under the canopy 46 between the roof trusses of the canopy 46. As a consequence, space 75 is also subject to the suction exerted through orbital conduits 48 connecting the suction chamber 45 to the donut casing 49.

Again, in accordance with my invention, the suction chamber 45 is extended to the center well 29 of rotary cylinder 28. Suction from the orbital conduits 48 causes air to flow from the center well 29 of the rotary cylinder 28 upwardly into and obliquely through the suction space 76 lying under the canopy 46 between the innermost truss 65 and the adjacent canopy-supporting member of its truss system.

My invention contemplates either the conventional discharge of the cleaned air from the high efficiency cyclone separator 52 directly into the ambient atmosphere or the unconventional discharge of that air back into the plenum chamber 11 so that its dust and heat contents are once again subject to recapture. The cyclone air outlet is recycled into the plenum chamber 11 through outlet pipe 78, which, preferably, is connected to the intake of one of the hot air blowers 16.

Both the partition wall 32 and the leveling board 33 are conventionally provided with yieldable sealing means (not shown) which scrape the wall of the bin.

Having described my invention, I claim:

1. A grain drying apparatus comprising:

A. a grain drying bin having a perforated floor through which hot air is blown upwardly for drying purposes;

B. a rotary sweep mounted in the bin for sweep movement over the floor, said sweep having distributing means on its lag side for distributing wet grain over the floor and radially-extending retrieving means on its lead side for removing dried grain from the floor;

C. means for feeding wet grain to said distributing means;

D. means for receiving dried grain from said retrieving means and conveying said dried grain outside of the bin;

E. a partition wall connected to a central portion of said rotary sweep and extending radially outward therefrom for movement over said floor with the movement of said rotary sweep, said wall extending between said distributing and retrieving means to separate the lag side from the lead side of said sweep; and F. means for building up the thickness of the dry grain on the lead side of the retrieving means including a rigid plate at least partially suspended from an upper portion of said wall and disposed in front and on the lead side of said retrieving means, said plate radially extending parallel to said retrieving means between said central portion and a sidewall of said bin, said plate being inclined with respect to a vertical plane through said bin such that its upper edge is relatively closer to said retrieving means than its lower edge, said lower edge being spaced above said floor to form a horizontally extending gap therebetween.

2. The apparatus of claim 1 further comprising means for adjusting the height of the lower edge of said thickness building means above said perforated floor to vary the width of said gap.

3. The apparatus of claim 2 wherein said height-adjusting means comprises an adjustable turnbuckle connected between an upper portion of said sweep and a lower edge portion of said plate, said partition wall extending upward in said bin between said distributing and retrieving means, an upper edge portion of said plate being pivotally attached to said partition wall, whereby adjustment of said turnbuckle lifts and lowers the lower edge portion of said plate to vary the width of said gap.

4. The apparatus of claim 1 wherein said distributing means is parallel with and spaced vertically above said retrieving means, said partition wall having horizontally offset upper and lower vertically extending portions and a slanted mid-portion connected between said horizontally offset upper and lower portions and extending through the space between said distributing and retrieving means, said plate being at least partially suspended from said offset upper portion of said wall.

5. The apparatus of claim 3 wherein said upper portion of said sweep to which said turnbuckle is connected is a suction chamber canopy.

* * * * *